United States Patent [19]

Crumpacker

[11] 4,160,394

[45] Jul. 10, 1979

[54] WRENCH

[76] Inventor: William H. Crumpacker, 1538 School Ave., Walla Walla, Wash. 99362

[21] Appl. No.: 891,701

[22] Filed: Mar. 30, 1978

[51] Int. Cl.[2] ..... B25B 13/52

[52] U.S. Cl. ..... 81/64; 81/65; 81/68

[58] Field of Search ..... 81/58, 60, 64, 65, 68, 81/69; 192/41 R

[56] References Cited

U.S. PATENT DOCUMENTS

| | | | |
|---|---|---|---|
| 1,400,456 | 12/1921 | Petrak | 81/64 |
| 1,638,918 | 8/1927 | Clark | 81/65 |
| 2,472,080 | 6/1949 | Jordan | 81/65 |
| 2,810,463 | 10/1957 | Williams | 81/58 |
| 3,372,781 | 3/1968 | Fulton | 81/58 |
| 3,477,486 | 11/1969 | Modrey | 81/58 |

*Primary Examiner*—James L. Jones, Jr.
*Attorney, Agent, or Firm*—Wells, St. John & Roberts

[57] ABSTRACT

A wrench adapted to turn a rotatable workpiece or tool about its central axis. The wrench comprises an elongated handle received through a bracket having an inwardly facing surface that engages the workpiece or tool. A pivotal connection between the inner end of the handle and the bracket permits adjustment of the handle about a pivot axis perpendicular to the longitudinal handle axis. A flexible loop is provided as a work-engaging member. It has one end connected to the inner end of the handle at one side of the pivot axis and its remaining end connected to the inner end of the handle at the opposite side of the pivot axis. Adjustment means is provided by manipulation of a sleeve surrounding a rigid inner handle section or shaft, the sleeve being both rotatable and axially movable with respect to the inner shaft. Radial cam surfaces are formed on the inner end of the sleeve and the outer end of the bracket to vary the angular position of the handle with respect to the bracket about the transverse pivot axis. Adjustment is accomplished by turning of the sleeve on the inner shaft. Abutment surfaces are provided between the cam plate and the outer end surfaces of the bracket for transmission of axial forces between the sleeve and handle shaft. The axial forces are adjusted by rotation of a threaded nut that encircles the outer end of the handle shaft and abuts the outer end of the sleeve. The wrench can be clamped to the workpiece or tool, or can be alternately clamped and released as it is oscillated about the central axis of the workpiece or tool.

11 Claims, 7 Drawing Figures

WRENCH

BACKGROUND OF THE INVENTION

This disclosure relates to a wrench that is adjustable about a workpiece or tool by elements located at the outer end of the wrench handle. This is contrasted with many prior types of wrenches which require adjustment adjacent to the workpiece or tool that is being turned by the wrench. Furthermore, the disclosed wrench is capable of use in a ratchet-type function, where the wrench is oscillated back and forth to turn the workpiece or tool in a common direction of rotation about its central axis. This is accomplished by frictional engagement between the wrench and the workpiece or tool, there being no mechanical pawl or other mechanism requiring at least a minimal angular movement between the wrench and workpiece or tool in order to be effective. The wrench is infinitely adjustable because of its frictional engagement with the workpiece or tool. The workpiece or tool can be gripped at any angular position about its central axis.

DESCRIPTION OF THE PREFERRED EMBODIMENTS

The present apparatus relates to a wrench for frictionally engaging a workpiece or tool for imparting movement to it in one rotational direction with respect to its central axis. It is designed as a substitute for conventional "ratchet type" wrenches, which typically use mechanical pawls and ratchet wheels to impart intermittent one-directional movement to a rotatable member.

In the following description, the elements of the wrench will be described in relation to their usage at a workpiece or tool that is to be rotated. The "inner" end of the wrench will designate its portions adjacent to or facing the workpiece or tool. The "outer" end of the wrench will designate its portions facing opposite to or remote from the workpiece or tool.

Figure 1:
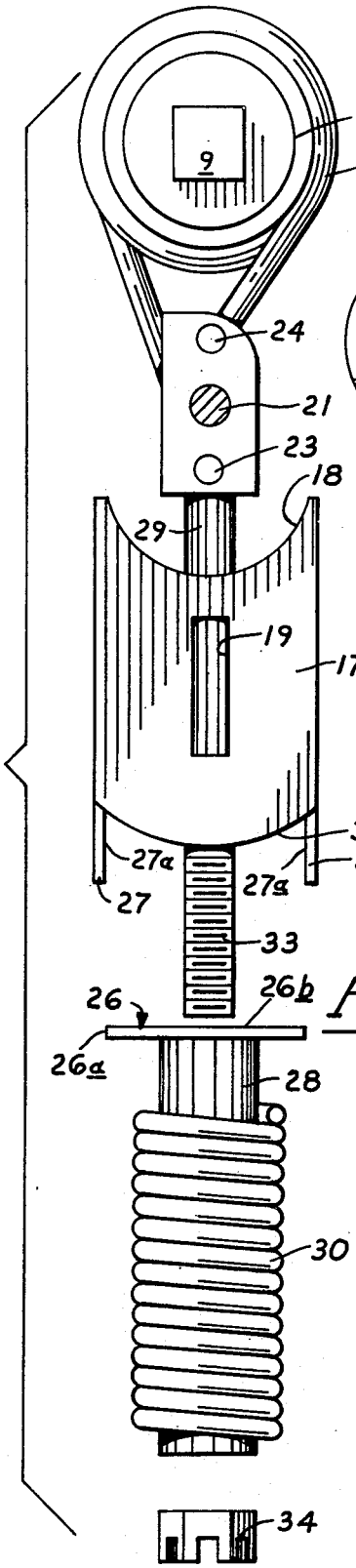
FIG. 1 is an exploded view of a first embodiment of my invention.
Figure 4:
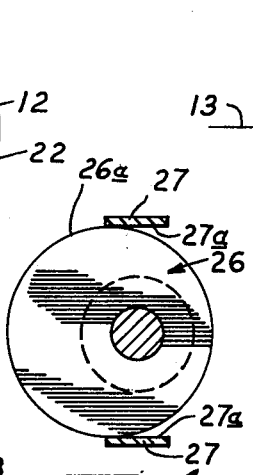
FIG. 4 is a sectional view taken on line 4—4 in FIG. 2.
Figure 2:
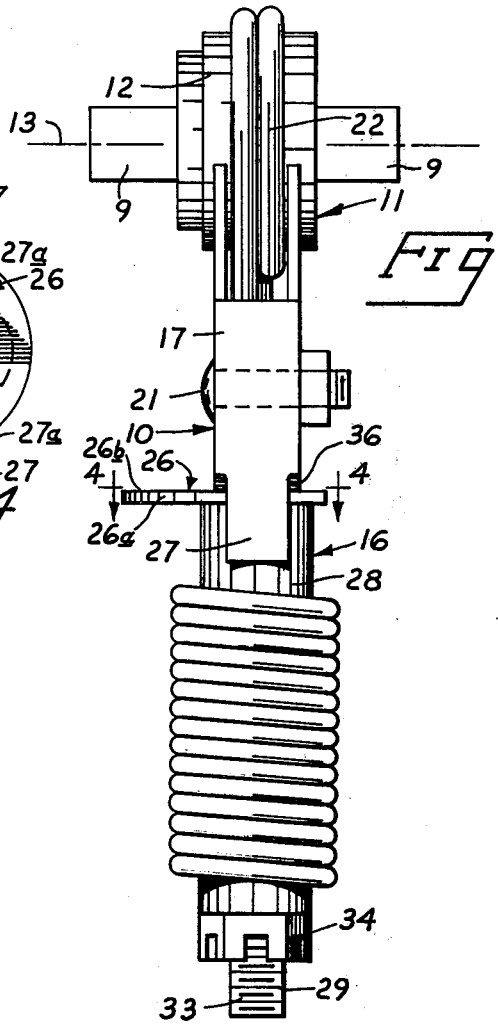
FIG. 2 is an assembled side view of the embodiment shown in FIG. 1.
Figure 5:
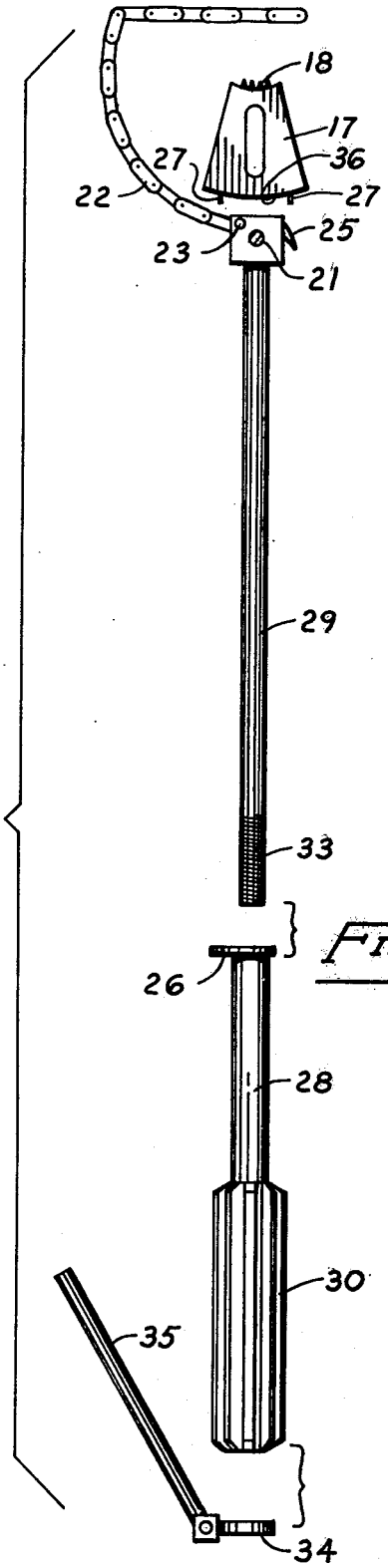
FIG. 5 is an exploded view of another embodiment of my invention.
Figure 6:
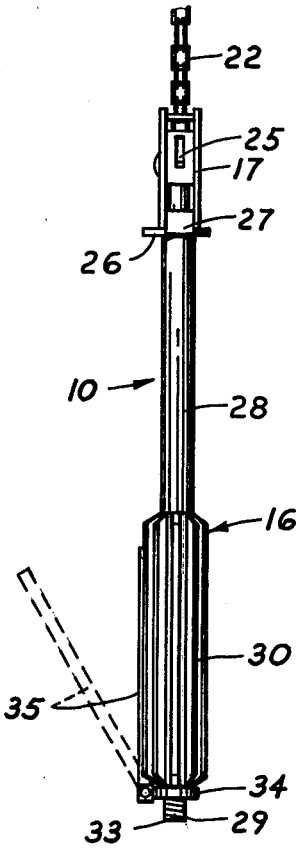
FIG. 6 is an assembled view of the embodiment shown in FIG. 5.
Figure 7:
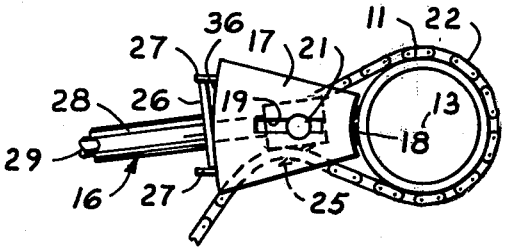
FIG. 7 is a fragmentary view illustrating operation of the embodiment shown in FIG. 6.

FIGS. 1 through 4 show a first form of the invention, and FIGS. 5 through 7 show a second form. In the embodiment shown in FIGS. 1 through 4, the wrench is illustrated as being adapted specifically for rotation of a workpiece or tool of a single circumference, while the embodiment of FIGS. 5 through 7 illustrates a wrench that is adjustable to a workpiece or tool of various diameters. The workpiece or tool itself can be in any form capable of being rotated about an axis in at least one direction. FIGS. 1 through 4 show the wrench specifically used with a tool having outwardly protruding socket mounts coaxially arranged along its central axis. FIG. 7 shows a second embodiment of the invention gripping a length of cylindrical pipe or tubing. These specific items are illustrated only by way of example, and it is to be understood that the wrench can be designed for use in the rotation of any type of rotatable workpiece or tool.

Referring now to FIGS. 1 through 4, the wrench is generally designated by the reference numeral 10. It is shown as it would be designed for turning a workpiece or tool 11 in a selected direction of rotation about is central axis, illustrated by line 13 in FIG. 2. With respect to this particular embodiment, the member 11 is shown as a tool having a cylindrical surface 12 frictionally engaged by wrench 10. It includes protruding socket mounts 9. The tool might be adapted to receive sockets or to otherwise be releasably engaged with an apertured fastener, a bolt head or a nut. The two mounts 9 permit turning of the member in either direction of rotation by simply reversing the position of tool 11 and wrench 10.

Wrench 10 includes an elongated handle 16 arranged along a longitudinal axis. The handle 16 is provided with an inner end adjacent to and facing tool 11, and an outer end facing oppositely. The handle structure includes a rigid handle section 29 in the form of a shaft having an outer cylindrical surface centered about the longitudinal handle axis. A portion of the rigid handle section 29 is surrounded by a coaxial sleeve 28 which is rotatable about the longitudinal axis for turning movement. A hand grip 30 is fixed about sleeve 28 to facilitate holding and turning of sleeve 28 when using the wrench 10.

The outer end of the rigid handle section 29 is threaded as shown at 33. Threads 33 are engaged by a complementary nut 34 that abuts the outer end of sleeve 28. Nut 34 adjustably locates sleeve 28 relative to shaft 29 along the longitudinal handle axis.

A bracket 17 is engaged by the inner end of sleeve 28. Bracket 17 is hollow and encircles shaft 29, which is movably located within its interior. Bracket 17 has a box-like configuration including parallel spaced plates and perpendicular side walls. The spaced plates have slotted guides 19 formed through them. The slotted guides 19 are complementary to a pivot shaft 21, which is illustrated as being a conventional nut and bolt assembly movably interconnecting the inner end of handle 16 to the bracket 17. The pivot shaft 21 is movably located within slotted guide 19 to permit movement of the handle about its central pivot axis. The pivot axis is perpendicular to the longitudinal handle axis. In addition, the pivot axis itself can be moved inward or outward along the length of the slotted guide 19.

The bracket 17 includes inwardly facing surfaces 18 complementary to the workpiece or tool 11 with which the wrench 10 is to be used. Surfaces 18 bear against the cylindrical surface 12 of the tool 11 to maintain bracket 17 in a radially protruding position with respect to the tool 11.

Tool 11 is frictionally engaged by loop means shown in the form of a wire band 22 having one end 23 mounted to the inner end of the rigid handle section 29 and having its opposite end mounted to the rigid handle section at 24. The two connections 23, 24 are located at opposite sides of the pivot axis presented by pivot shaft 21. The ends of the wire band 22 are pivotally mounted to the rigid handle section 29 about axes parallel to the pivot axis. When a turning force is exerted on the handle about the pivot axis at shaft 21, the effective length of the wire band 22 will be either decreased or increased, depending upon the direction of turning force. As viewed in FIGS. 1 and 3, counterclockwise movement will tighten band 22, and clockwise movement will loosen its grip on the tool 11. Thus, one can turn tool 11 intermittently about its central axis 13 by alternately cranking the handle 16 about the pivot axis of shaft 21 in a counterclockwise direction. During that portion of each stroke during which handle 16 moves in a clockwise direction, no rotational movement will be imparted to the tool 11 in resistance to a workload, since the frictional engagement between wire band 22 and surface 12 will be substantially decreased.

To provide some initial frictional bias to the wire band 22, two forms of adjustment means are operatively provided between the handle elements and bracket 17. The first comprises cam means operably mounted on the handle assembly and the bracket for angularly locating the rigid handle section 29 and bracket 17 relative to one another about the pivot axis across shaft 21. The cam means is shown as an eccentric circular cam plate 26 having a peripheral edge **26*a*. The cam plate 26 is fixed to the inner end of sleeve 28 as an integral part thereof. Edge 26*a* frictionally engages the inner surfaces 27*a* of protruding side walls 27 integral to the bracket 17 (FIG. 4**).

The second adjustment means comprises complementary abutment surfaces operably engaged between the handle assembly and the bracket for locating the handle and bracket relative to one another radially with respect to the central axis 13 of the tool 11 encircled by the loop means or band 22. Such movement is permitted by the slotted guide 19. The location of pivot shaft 21 along the slotted guide 19 is controlled by frictional engagement between the inwardly facing transverse surface **26*b* across the plate 26 and the outwardly facing edge 36 on bracket 17. The axial location of sleeve 28 relative to the rigid handle section 29 is controlled by adjustment of nut 34. Nut 34 is turned to provide an adjustable compressive force on sleeve 28 and bracket 17 in opposition to the surface 12 of the tool 11 engaged by the surfaces 18. This tends to tension or stretch the wire band 22 in a direction parallel to the longitudinal axis of the handle assembly, thereby increasing frictional engagement between the wire band 22 and the tool 11**.

Figure 3:
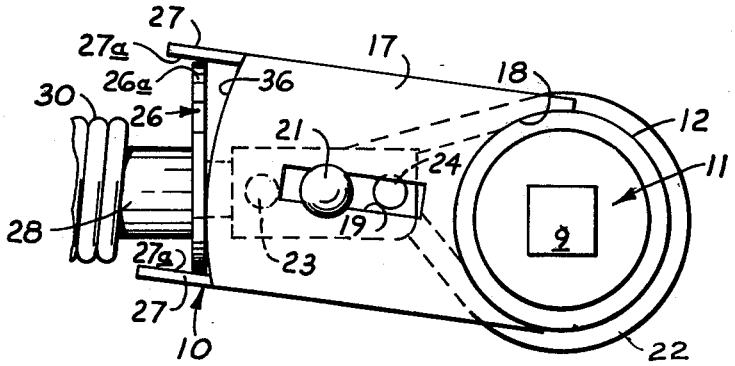
FIG. 3 is a fragmentary view illustrating operation of the embodiment shown in FIGS. 1 and 2.

When using this first embodiment of the invention, one can preset the frictional engagement of the tool 11 by tightening nut 34 until sufficient frictional engagement is achieved to assure turning of the work involved. Additional force can be provided by rotating sleeve 28 about the rigid handle section 29, causing cam plate 26 to pivot the handle about the axis of shaft 21 with respect to bracket 17. As can be seen in FIG. 3, this effectively tightens the grip of the band 22 about the surface 12. When using the wrench in a ratchet type operation, where it is pumped or cranked back and forth to impart rotation to the tool 11 in one rotational direction, one can assure release of tool 11 by rotating sleeve 28 slightly in the opposite direction as the handle is pulled backwards. By alternately twisting and cranking the handle, one can have substantial control over the frictional engagement between the wrench and the workpiece or tool.

It is important to emphasize that the adjustment of the wrench is accomplished by manipulation of the grip 30 and outer nut 34. Both are normally accessible to the user even when using the inner end of the tool at an inaccessible location. This permits one-handed adjustment of the wrench to assure proper frictional grip of the tool 11. It eliminates the need to remove the wrench from the work as is the case with alternate types of tools now available.

The second form of the invention, shown in FIGS. 5 through 7, is basically very similar to the first embodiment and similar reference numerals have been used in the drawings where applicable. To show the versatility of the basic wrench structure, the second embodiment is illustrated with an adjustable loop means in the form of a length of chain 22 anchored to the handle section 29 at 23. The free end of the length of chain 22 is releasably secured to a protruding hook 25 also at the inner end of the handle section 29. Again, the loop connections 23, 25 are located at opposite sides of the pivot shaft 21 so that pivotal movement of the handle section 29 about the transverse pivot axis of shaft 21 will effectively vary the circumference of the loop formed by chain 22.

The bracket 17 is basically identical to that previously disclosed, and includes inwardly facing serrated surface 18 for gripping the workpiece or tool within the loop means, and outwardly facing surfaces 36 for abutment by the cam plate 26. The angular and axial relative positions between the handle and bracket are controlled by rotating cam plate 26 relative to handle section 29 and by turning nut 34, which is threadably engaged with the outer end of shaft section 29. This adjustability has been described in greater detail with respect to the first embodiment.

In this form of the invention, the hand grip 30 has longitudinal grooves formed therein, which are complementary to a pivoted lever 35 mounted to the nut 34. One can therefore turn nut 34 to any desired position with respect to the handle section 29, and subsequently pivot the lever 35 inwardly to a position parallel to the handle and lying within a selected groove as shown in FIG. 6. This interlocks the nut 34 and the hand grip 30 to prevent relative rotation between them. Thus, as the grip 30 is pivoted about the longitudinal axis of the handle section 29, nut 34 will be alternately tightened or loosened. This permits one to simultaneously vary the axial position of pivot shaft 21 along the slotted guide 19 at the same time that the angular position of handle section 29 is varied about the axis of pivot shaft 21 by action of the cam plate 26. Otherwise, the use of the second embodiment of the wrench is basically identical to that previously described.

The wrench is shown in both embodiments can be either securely attached to the workpiece 11 to rotate about its central axis, or can be alternately tightened and loosened to act as a frictional ratchet-type wrench to impart rotation in one direction.

Modifications are obviously possible with respect to the details of the wrench as shown in the drawings. For this reason, only the following claims are set out as definitions of the disclosed invention itself.

Having described my invention, I claim:

1. A wrench adapted to turn a rotatable workpiece or tool about its central axis, comprising:

an elongated handle having an inner end and an outer end located along a longitudinal axis;

a bracket having inwardly facing surface means formed thereon for engagement against a workpiece or tool;

pivot means operably connecting said bracket to the inner end of said handle about a pivot axis perpendicular to said longitudinal axis;

loop means extending inwardly beyond said surface means of the bracket for encircling a workpiece or tool engaged by said surface means, said loop means comprising a flexible element having one end operably mounted to the inner end of said handle at one side of the pivot axis and its remaining end operably mounted to the inner end of said handle at the opposite side of the pivot axis;

and adjustment means operably mounted between said handle and said bracket for movably locating them relative to one another.

2. A wrench as set out in claim 1 wherein said adjustment means comprises:

cam means operably mounted on said handle and said bracket for angularly locating the handle and bracket relative to one another about said pivot axis.

3. A wrench as set out in claim 1 wherein said adjustment means comprises:

abutment means operably engaged between said handle and bracket for locating the handle and bracket relative to one another in a radial direction with respect to the central aixs of a rotatable workpiece or tool encircled by said loop means.

4. A wrench as set out in claim 1 wherein said pivot means comprises:

a shaft and complementary slotted guide for the shaft permitting inward or outward relative movement between the handle and bracket.

5. A wrench as set out in claim 1 wherein said pivot means comprises:

a transverse pivot shaft mounted to the inner end of said handle;

an elongated slotted guide formed on said bracket and movably receiving said pivot shaft to thereby permit inward or outward relative movement between the handle and bracket.

6. A wrench as set out in claim 1 wherein said pivot point comprises:

a transverse pivot shaft mounted to the inner end of said handle;

an elongated slotted guide formed on said bracket and movably receiving said pivot shaft to thereby permit inward or outward relative movement between the handle and bracket;

and abutment means operably engaged between said handle and bracket for locating the pivot shaft along said slotted guide.

7. A wrench as set out in claim 1 wherein said elongated handle comprises:

a rigid section integral with the inner end of the handle;

a tubular sleeve coaxially mounted about said rigid section for pivotal movement relative to the rigid section about said longitudinal axis;

said adjustment means comprising complementary radial cam means generated about said longitudinal axis and formed on the sleeve and bracket in engagement with one another for causing the handle and bracket to pivot relative to one another about said pivot axis.

8. A wrench as set out in claim 1 wherein said elongated handle comprises:

a rigid section integral with the inner end of the handle;

a tubular sleeve coaxially mounted about said rigid section for translational movement relative to the rigid section along said longitudinal axis;

said adjustment means comprising complementary abutment means on the sleeve and bracket in engagement with one another for locating the handle and bracket relative to one another in a radial direction with respect to the central axis of a rotatable workpiece or tool encircled by said loop means.

9. A wrench as set out in claim 8 further comprising:

complementary threaded means operatively engaged between the outer end of said handle and said sleeve for locating said collar relative to said rigid section along said longitudinal axis.

10. A wrench adapted to turn a rotatable workpiece or tool about its central axis, comprising:

an elongated handle section having an inner end and an outer end located along a longitudinal aixs;

a bracket having an inwardly facing surface and an opposed outwardly facing surface;

a pivot shaft mounted to the inner end of said handle section presenting a pivot axis perpendicular to said longitudinal axis;

slotted guide means extending between the inwardly and outwardly facing surfaces on said bracket, operably connected to said pivot shaft for movably mounting said bracket to the inner end of said handle section for pivotal movement between them relative to the pivot axis and for translational movement of said pivot shaft along the length of said slotted guide means;

loop means extending inwardly beyond said inwardly facing surface of the bracket for encircling a workpiece or tool engaged by said inwardly facing surface, said loop means comprising a flexible element having one end operably mounted to the inner end of said handle section at one side of said pivot axis and its remaining end operably mounted to the inner end of said handle at the opposite side of said pivot axis;

an adjustment means operably engaged between said handle section and said bracket for movably locating them relative to one another both about the pivot axis and along the length of said slotted guide means.

11. A wrench as set out in claim 10 wherein said adjustment means comprises complementary radial cam means generated about the longitudinal axis of the handle section for pivoting the bracket about the pivot axis relative to the handle section in a direction opposite to the pivotal moment exerted on the handle with respect to the pivot shaft when turning a workpiece or tool encircled by said loop means.

* * * * *